US006007383A

United States Patent [19]

Cabes

[11] Patent Number: 6,007,383

[45] Date of Patent: Dec. 28, 1999

[54] REAR CONNECTION DEVICE FOR A SCREENED CABLE ELECTRICAL CONNECTOR

[75] Inventor: Robert Cabes, Montmirail, France

[73] Assignee: Axo'n Cable S.A., Montmirail, France

[21] Appl. No.: 08/945,189

[22] PCT Filed: Apr. 19, 1996

[86] PCT No.: PCT/FR96/00599

§ 371 Date: Oct. 17, 1997

§ 102(e) Date: Oct. 17, 1997

[87] PCT Pub. No.: WO96/33524

PCT Pub. Date: Oct. 24, 1996

[30] Foreign Application Priority Data

Apr. 19, 1995 [FR] France ..... 95 04634

[51] Int. Cl.[6] ..... H01R 9/03

[52] U.S. Cl. ..... 439/610

[58] Field of Search ..... 439/610, 583, 439/95, 92, 98, 445, 447, 607

[56] References Cited

U.S. PATENT DOCUMENTS

| | | | |
|---|---|---|---|
| 3,889,046 | 6/1975 | Oberdiear . | |
| 4,921,449 | 5/1990 | Fish | 439/610 |
| 5,417,587 | 5/1995 | Katsuda et al. | 439/559 |
| 5,536,185 | 7/1996 | Guiol | 439/610 |

FOREIGN PATENT DOCUMENTS

| | | |
|---|---|---|
| 0 191 673 A1 | 8/1986 | European Pat. Off. . |
| 0 295 154 A2 | 12/1988 | European Pat. Off. . |
| 0 542 102 A1 | 5/1993 | European Pat. Off. . |
| 2 256 097 | 11/1992 | United Kingdom . |

*Primary Examiner*—Steven L. Stephan
*Assistant Examiner*—Eugene G. Byrd
*Attorney, Agent, or Firm*—Wolf, Greenfield & Sacks, P.C.

[57] ABSTRACT

The invention relates to a rear mounting device for a connector for a shielded cable comprising a sheath of outside diameter (D1), one or more shielding braids of diameter (D2), and a plurality of electrical conductors. The device comprises:

a shielding take-up piece (54) having a sleeve (70) whose outside diameter is substantially equal to D2 for fixing to said braid, a first bearing surface (76), and an axial bore (78) suitable for allowing said electrical conductors to pass therethrough;

a fixing piece (52) defining a cavity that is open at a first end (60) for fixing to the connector and closed by a wall (58) defining a second bearing surface (64) inside said cavity and presenting an axial orifice (62) of diameter not less than D1, said take-up piece being capable of penetrating freely into the cavity; and a nut (56) for fastening the take-up piece to the fixing piece.

9 Claims, 3 Drawing Sheets

REAR CONNECTION DEVICE FOR A SCREENED CABLE ELECTRICAL CONNECTOR

The present invention relates to a rear mounting device for an electrical connector for a shielded cable.

More precisely, the present invention relates to the piece in an electrical connector referred to as a "rear mount" and that serves in particular to take up the shielding of the electrical cable.

Shielded wire links are used wherever electro-magnetic problems may be encountered. The designer of an electrical installation must therefore define an electrical link with specified shielding performance complying with civilian or military standards. All of the elements comprising the electrical link must therefore be specified. Thus, the cable constituting the link must have shielding presenting defined values, and the connector portion must also have the corresponding required characteristics. The connector portion comprises two main portions: the special connector proper which satisfies well-specified standards, and the mounting portion made up of a "rear accessory" having at one of its ends a fitting capable of being mounted on the connector proper and at its other end a fitting capable of taking up the general shielding of the cable together with any shielding that there may be of the component elements of the cable.

Two well-known main techniques already exist for mounting the connector on the cable. Accompanying FIG. 1 shows the connector proper 10, the cable 12 with its shielding braid 14 and its main electrical conductors 16. In this implementation, the rear mounting device 18 is of large diameter so that the rear mount 18 can be moved away from the connector 10 by sliding along the cable 12, thereby leaving enough room to wire the electrical conductors 16 to the connector under good conditions. After the wiring has been done, the rear mount 18 is put into place on the connector 10 and the shielding braid 14 must be crimped to the shielding take-up portion 20. However, given the large diameter of the shielding take-up portion 20, the braid 14 must be deformed mechanically in order to increase its diameter to the diameter of the shielding take-up tube. Such a solution allows wiring to be performed under good conditions and therefore at relatively low cost, however it is unsuitable when the shielding needs to comply with tight conditions, specifically those relating to taking up the shielding braid on the rear mount.

The other solution consists in providing a tube or sleeve for taking up the shielding 22 having an outside diameter that is substantially equal to the diameter of the shielding braid 24. However, it will be understood that under such circumstances, it is not possible to cause the rear accessory of the connector to slide along the entire cable to make room for effecting the wiring. The problem in such a system is thus that the space available for wiring the primary conductor elements to the connector proper is very small.

Such difficult conditions for wiring the primary elements on the connector considerably increase the cost of this operation, due essentially to the increase in time required to perform the wiring, and in addition such conditions run the risk of leading to damage to certain primary conductor elements, thus making the wiring unreliable.

To remedy those drawbacks, various other solutions have been proposed. U.S. Pat. Nos. 4,111,513, 3,944,317, and 4,671,598 describe various solutions which attempt to resolve the above-mentioned problem. Nevertheless, those solutions lead to connectors that are relatively complex and their mounting operations remain relatively lengthy.

The object of the present invention is to provide a rear mounting device for an electrical connector for a shielded cable making it possible simultaneously to take up the shielding in compliance with the specific standards that are in force while also enabling wiring operations to be performed on the primary electrical conductors under good conditions.

According to the invention, this object is achieved by a rear mounting device for a connector for a shielded cable including an outer sheath, one or more shielding braids, and a plurality of electrical conductors that are individually shielded by braid or that are not shielded, said sheath having an outside diameter D1, and said braid(s) having a diameter D2, where D2 is less than D1, the mounting device being characterized in that it comprises:

a shielding take-up piece having a first end constituted by a sleeve whose outside diameter is substantially equal to D2 for fixing to said braid(s), and a second end having a first bearing surface directed towards said sleeve, said take-up piece having an axial bore suitable for allowing said electrical conductors to pass therethrough;

a fixing piece defining a cavity that is open at a first end and closed by a wall at its second end, said wall defining a second bearing surface inside said cavity and having an axial orifice of diameter not less than D1, said take-up piece being capable of penetrating freely in the cavity of said fixing piece, said first end of the fixing piece is provided with fixing means for fixing to said connector; and fastener means external to said fixing piece for fastening the take-up piece and the fixing piece together so that their respective bearing surfaces are pressed against each other, said first end of the take-up piece passing through said orifice.

It will be understood that because of the invention, the rear mounting device is constituted essentially by a take-up piece and by a fixing piece that are separate from each other. Thus, to perform the operation of wiring the primary conductors and of taking up the shielding braid, it is possible to move the fixing piece away, which piece can slide freely along the cable, and to put said fixing piece back into place only once all of the wiring operations have been performed under conditions of good accessibility. The shielding is taken up after the fixing piece has been secured to the connector.

Preferably, said second bearing surface is constituted by the wall of said axial orifice, said wall being in the form of a truncated cone whose apex lies outside said cavity, and said first bearing surface is constituted by a second frustoconical surface, disposed between the sleeve and the second end of said take-up piece, said first and second frustoconical surfaces providing clamping conical engagement when said first end of the take-up piece is engaged in the axial orifice of the fixing piece with said sleeve projecting out from said fixing piece.

In a variant embodiment, the fixing piece is constituted by a metal cap and said second portion is plane, and said take-up piece further comprises a plane plate on which said sleeve is fixed and provided with an orifice facing said sleeve, said plate being substantially orthogonal to said sleeve, the periphery of said plate constituting said first bearing surface.

Other characteristics and advantages of the present invention appear better on reading the following description of various embodiments of the invention given as non-limiting examples. The description refers to the accompanying figures, in which:

FIG. 1, described above, shows a first embodiment of a prior art rear mounting device;

FIG. 2, described above, shows a second embodiment of a prior art rear mounting device;

Figure 9A:
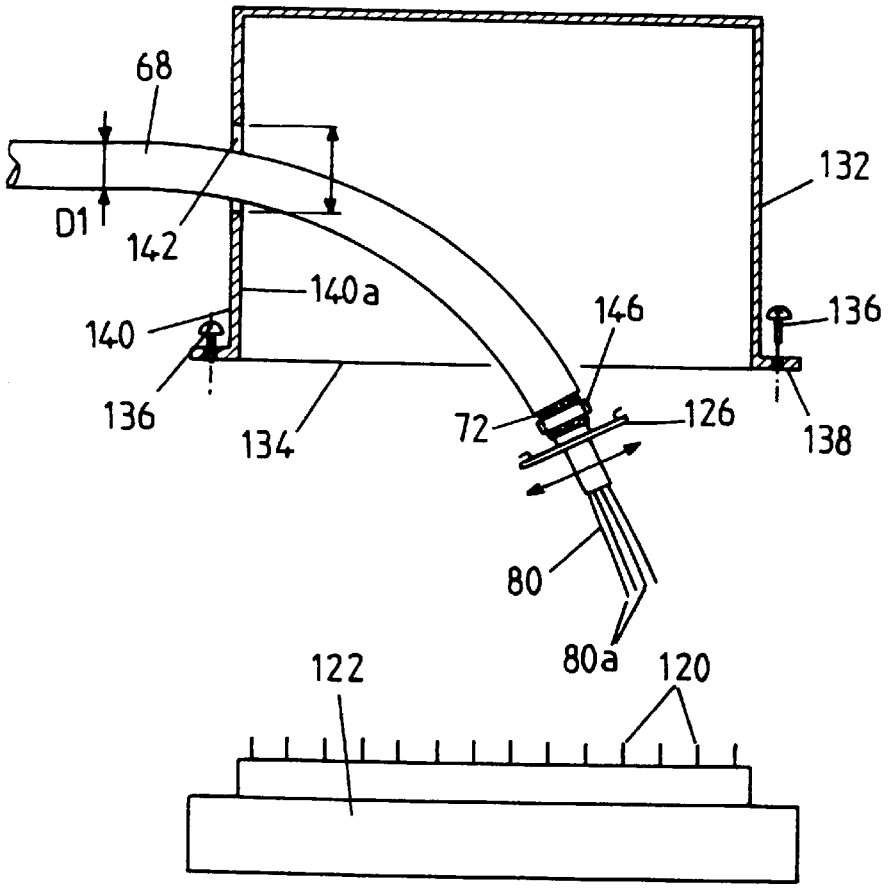
Figure 9B:
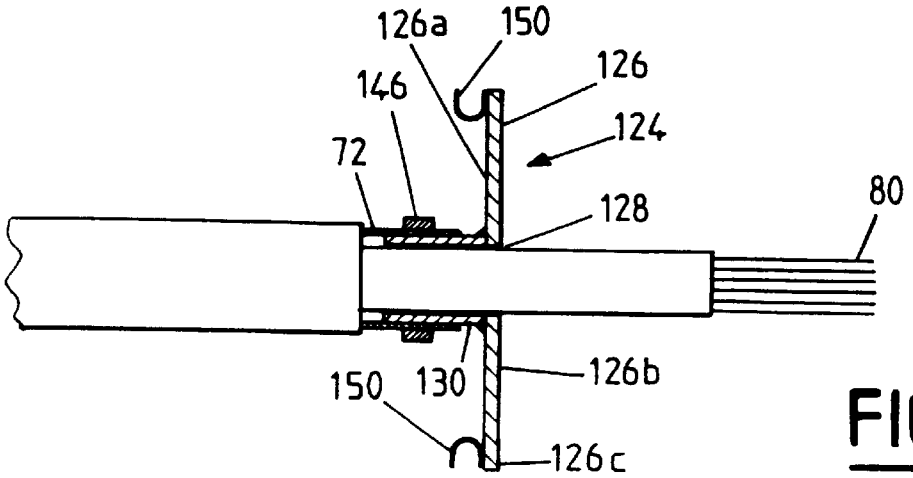

FIG. 9*a* is a longitudinal section through an embodiment of a rear take-up piece including a shielding cap; and FIG. 9*b* is a detail view of FIG. 9*a* showing how the shielding braid of the cable is fixed to the shielding take-up piece.

Figure 3:
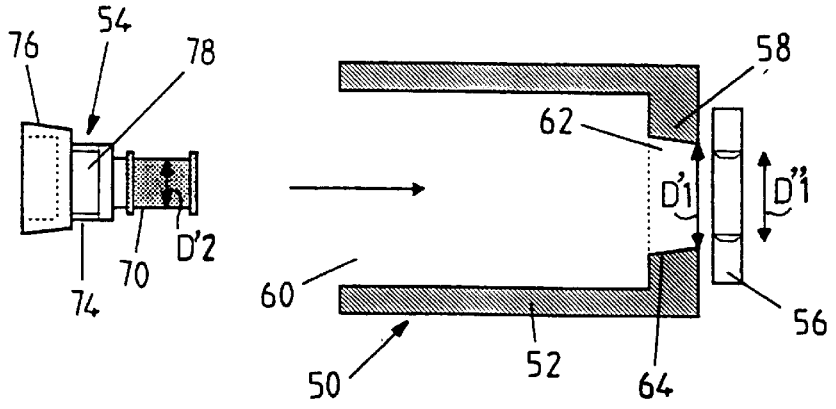
FIG. 3 is a longitudinal section through an embodiment of a rear mounting device of the invention.
Figure 4:
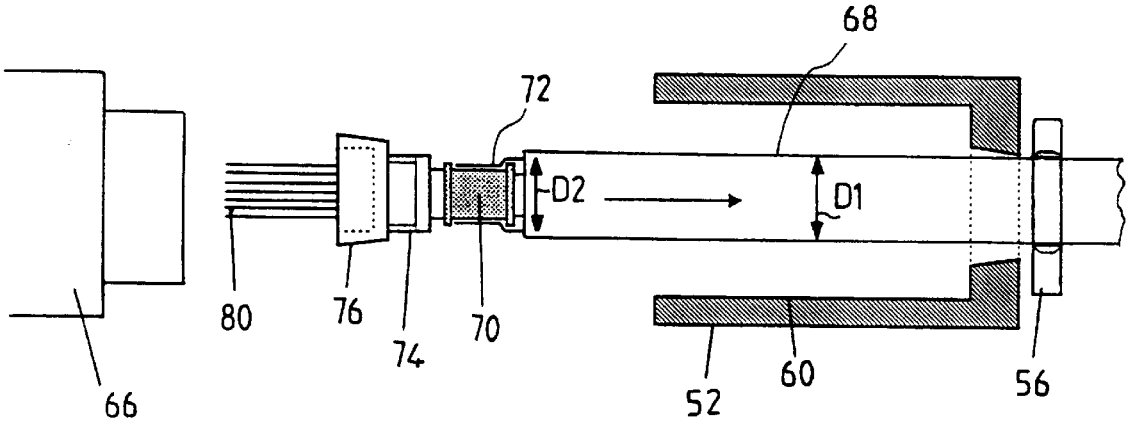
FIG. 4 shows how the FIG. 3 rear mounting device is used.

With reference initially to FIGS. 3 and 4, a first embodiment of the rear mounting device is described. The rear mounting device given overall reference 50 is essentially constituted by a fixing piece 52, a shielding take-up piece 54, and a fastener member 56.

Preferably, the fixing piece 52 is in the form of a cylindrical sleeve having one end closed by a wall 58. The sleeve 52 thus defines a cylindrical cavity of diameter that is sufficient to receive the piece 54 freely via its end 60 which is open. The wall 58 is pierced by an axial orifice 62. The inside wall 64 of the orifice 62 is preferably in the form of a truncated cone whose apex lies outside the cavity. The minimum diameter D'1 of the axial orifice 62 is greater than the outside diameter D1 of the cable 68 on which the connector 66 is to be mounted.

The take-up piece 54 comprises firstly a shielding take-up sleeve 70 of outside diameter D'2 which is substantially equal to the diameter D2 of the shielding braid 72 of the cable 68 on which the connector 66 is to be mounted. Thereafter it has a threaded portion 74 whose outside diameter is smaller than the diameter D'1. Finally, it has a portion 76 defining a frustoconical outside surface to co-operate with the frustoconical surface 64 of the orifice 62 to provide clamping conical engagement. In addition, the piece 54 is pierced by an axial bore 78 for passing the electrical conductors 80 for wiring to the connector. Finally, the rear mount includes a fastening nut 56 suitable for co-operating with the threaded portion 74 of the take-up piece 54 once engaged in the fixing piece 52. By bearing against the outside face 58*a* of the wall 58, the nut 56 fastens the take-up piece 54 to the fixing piece 52. The inside diameter D"1 of the nut is greater than the outside diameter D1 of the cable 68.

Wiring is performed as follows: the piece 52 and the nut 56 are slid away from the end of the cable 68 on which the connector 66 is to be mounted. The ends of the primary conductors 80 of the cable are inserted through the axial bore 78 of the take-up piece 54 and the shielding braid 72 is crimped onto the sleeve 70. The ends of the primary conductors 80 are then electrically connected to the electrical contacts of the connector. This operation is easily done since the fixing piece 52 is out of the way. Once the connections have been made, the fixing piece 52 is moved back again to have its end 60 fixed onto the rear face of the connector 66. The fixing means are well known and are not shown in FIGS. 3 and 4.

After this fixing has been done, the sleeve 70 and the threaded portion 74 project out from the fixing piece 52. The nut 56 is then screwed onto the threaded portion 74 of the take-up piece 54. Wiring is then completed.

Figure 5:
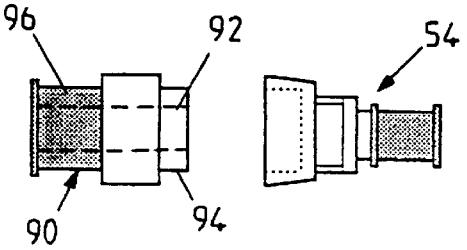
FIGS. 5 and 6 are elevation views showing two variant embodiments of the take-up piece when there exists internal shields in the electrical cable.

When the cable 68 includes conductors that are individually shielded by braid, it is possible also to provide an additional take-up piece 90 having an axial bore 92, a first end 94 for fixing to the take-up piece 54, and a sleeve 96 which takes up all of the individual shields. This is shown in FIG. 5.

Figure 6:
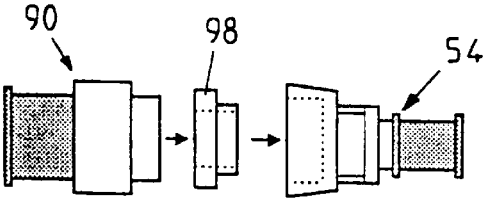

If electrical insulation is required between the individual shields of the component elements and the overall shields, it is possible to interpose a ring 98 of insulating material between the take-up pieces 54 and 90, as shown in FIG. 6.

Figure 1:
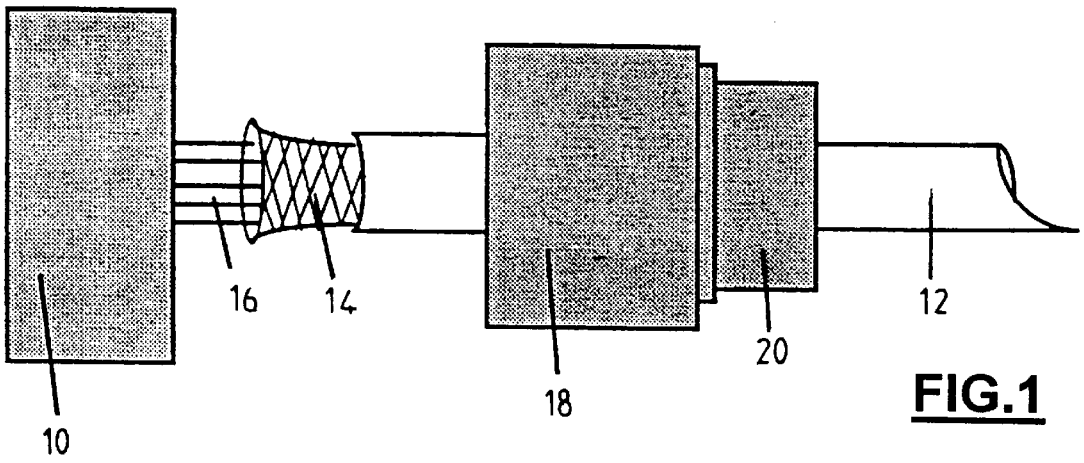
Figure 2:
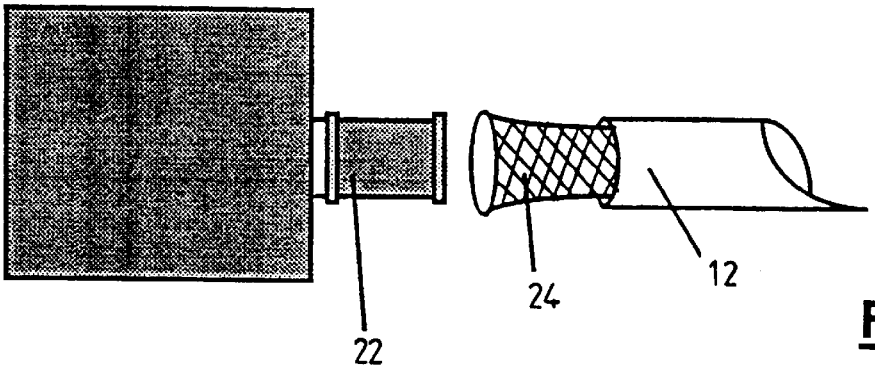
Figure 7:
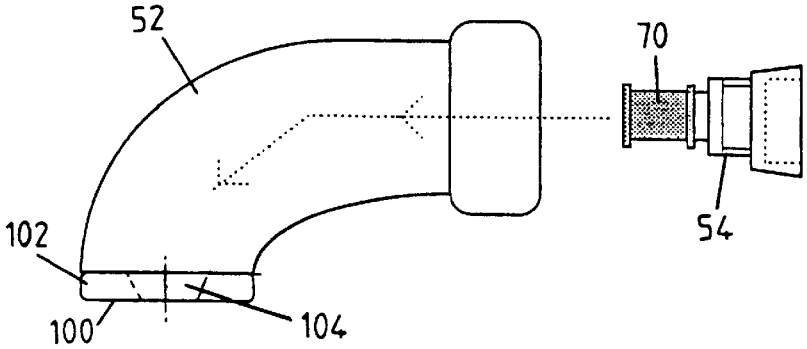
FIG. 7 is an elevation view of a variant of the fixing piece when it comprises a bend.

FIG. 7 shows an embodiment of the invention when the rear mount constitutes a bend. It will be understood that in this case that the problem of making room for effecting the wiring is even more acute. The fixing piece is referenced 52' and has the desired bend shape, while the take-up piece 54 is identical to that of FIGS. 3 and 4. The end 100 of the piece 52' is closed by a wall 102 that is pierced by a frustoconical orifice 104 suitable for co-operating with the frustoconical bearing surface of the take-up piece 54. The diameter of the orifice 104 is large enough to allow the cable on which the connector is to be mounted to pass freely therethrough. A nut (not shown in FIG. 7) serves to fasten the pieces 52' and 54 together.

Figure 8:
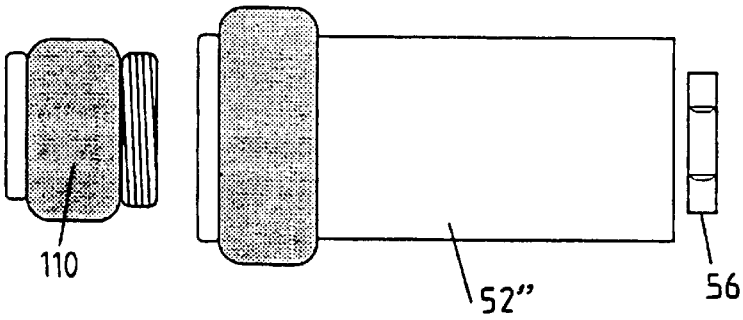
FIG. 8 shows another embodiment of the fixing piece when the cable to be connected is of a diameter that is larger than that normally designed to be wired to the connector.

FIG. 8 shows another variant embodiment of the invention for the case when the outside diameter D1 of the cable is larger. Under such circumstances, a fixing piece 52" and a take-up piece (not shown in FIG. 8) are used having diameters compatible with the outside diameter of the cable. To compensate for the increase in diameter, a coupling piece 110 is provided suitable for fixing to the rear face of the connector and to the end of the piece 52" so as to couple between the larger diameter of the fixing piece 52" and the standard diameter of the connector.

With reference now to FIGS. 9*a* and 9*b*, a second embodiment of the invention is described in which the fixing piece is a shielding cap and the connector is rectangular.

In FIG. 9*a*, there can be seen the cable 68 of outside diameter D1 with its shielding braid 72 and its primary conductors 80 whose ends 80*a* are to be fixed to the terminals 120 of the connector 122. In the example described, the connector is rectangular. The take-up piece 124 which can be seen more clearly in FIG. 9*b* is constituted by a conductive plate 126, e.g. of rectangular shape, and pierced by an axial orifice 128. The screening take-up sleeve 130 is fixed on the outside face 126*a* of the plate 126 in register with the orifice 128.

The fixing piece is constituted by a shielding cap 132 made from conductive sheet metal. One of the faces 134 of the rectangular parallelepiped is open and is designed to receive the body of the connector 122. This can be fixed to the cap by means of screws 136 mounted in a rim 138 of the cap.

The face 140 of the cap 132 is pierced by an orifice 142 that is rectangular in shape. Naturally, the orifice 142 could also be circular or oblong.

The dimensions of the orifice 142 are smaller than the dimensions of the plate 126 of the take-up piece 124.

The connector is wired as follows:

Before the connector 122 is fixed to the cap 132, the end of the cable 68 is inserted into the cap through the orifice 142, this end having the shielding braid 72 and the primary conductors 80 appropriately stripped. The take-up piece 124 is engaged around the end of the cable so that the end of the braid surrounds the sleeve 130 and the end of the cable passes along the sleeve and through the orifice 128 to project beyond the inside face 126*b* of the plate 126. The end of the braid 72 is fixed to the sleeve 130, e.g. by means of a clamping collar 146.

Thereafter, the ends of the primary conductors 80 are wired to the terminals 120 of the connector 122. This wiring can be performed under convenient circumstances since the end of the cable projects out from the cap 132 through its open face 134.

Thereafter, the cable 68 fastened to the take-up piece 124 and to the connector 122 is slid through the orifice 142 until the periphery 126*c* of the outside face of the plate 126 bears against the inside face 140*a* of the wall 140 of the cap in its zone surrounding the orifice 142. Thereafter the plate 126 is fixed to the wall 140 of the cap by any convenient means. In the example described, resilient snap-fastening tabs 150 are provided which, by deforming, bear against the outside face of the wall 140. The resilient snap-fastening tabs could also be provided on the wall of the cap 132 to co-operate with the periphery of the plate 126.

Naturally, other fastening methods could be used such as screw-fastening, soldering, riveting, etc. . . . .

Finally, the connector 122 is fixed to the cap 132 in the opening 134.

I claim:

1. A rear mounting device for a connector for a shielded cable including an outer sheath, one or more shielding braids, and a plurality of electrical conductors that are individually shielded by braid or that are not shielded, said sheath having an outside diameter D1, and said braid(s) having a diameter D2, where D2 is less than D1, the mounting device being characterized in that it comprises:

a shielding take-up piece (54) having a first end constituted by a sleeve (70) whose outside diameter is substantially equal to D2 for fixing to said braid(s), and a second end having a first bearing surface (76) directed towards said sleeve, said take-up piece having an axial bore (78) suitable for allowing said electrical conductors to pass therethrough;

a fixing piece (52, 52', 52") defining a cavity that is open at a first end (6) and closed by a wall (58) at its second end, said wall defining a second bearing surface (64) inside said cavity and having an axial orifice (62) of diameter not less than D1, said take-up piece being capable of penetrating freely in the cavity of said fixing piece, said first end (60) of the fixing piece is provided with fixing means for fixing to said connector; and fastener means (56) external to said fixing piece for fastening the take-up piece and the fixing piece together so that their respective bearing surfaces are pressed against each other, said first end of the take-up piece passing completely through said orifice to extend outside said fixing piece.

2. A rear mounting device according to claim 1, wherein said second bearing surface is constituted by the wall of said axial orifice, said wall being in the form of a truncated cone whose apex lies outside said cavity, and said first bearing surface is constituted by a second frustoconical surface, disposed between the sleeve and the second end of said take-up piece, said first and second frustoconical surfaces providing clamping conical engagement when said first end of the take-up piece is engaged in the axial orifice of the fixing piece with said sleeve projecting out from said fixing piece.

3. A rear mounting device according to claim 2, wherein said external fastener means comprise a thread formed on the outside face of the take-up piece between the sleeve and said frustoconical surface, and a nut suitable for co-operating with said thread, said nut bearing against the outside face of the wall of the fixing piece when tightened.

4. A rear mounting device according to claim 1, for a cable further having a plurality of individually shielded conductors, wherein the mounting device further comprises an auxiliary shielding take-up piece having an axial bore suitable for allowing the bundle of electrical conductors to pass therethrough, a first end suitable for co-operating with the second end of the take-up piece, and a second end provided with a sleeve for fixing said braids of the individual shields.

5. A rear mounting device according to claim 1 wherein said fixing piece is in the form of a lengthwise bend.

6. A rear mounting device according to claim 1 wherein said fixing means for fixing the fixing piece to said connector are adapted to compensate for a difference in diameter between said fixing piece and said connector.

7. A rear mounting device according to claim 1, wherein:

said fixing piece is constituted by a metal cap and said second portion is plane; and said take-up piece also includes a plane plate on which said sleeve is fixed and provided with an orifice in register with said sleeve, said plate being substantially orthogonal to said sleeve, the periphery of said plate constituting said first bearing surface.

8. A rear mounting device according to claim 7, wherein said cap is substantially in the form of a rectangular parallelepiped, said open first end being a first face of said rectangular parallelepiped, said second end being provided with an orifice which is a second face of said rectangular parallelepiped orthogonal to said first face, and said cap being made of conductive sheet material.

9. A rear mounting device according to claim 8, wherein said fastener means comprise snap-fastening members secured to the outside face of said plate and being suitable for co-operating with the outside face of the periphery of the orifice formed in said second end of the cap.

* * * * *